United States Patent [19]

Wallander

[11] Patent Number: 5,032,262

[45] Date of Patent: Jul. 16, 1991

[54] DEVICE IN RINSING SCREENS

[75] Inventor: Carl-Otto Wallander, Västra Frölunda, Sweden

[73] Assignee: Hydropress Wallander & Co. AB, Sweden

[21] Appl. No.: 362,057

[22] Filed: Jun. 6, 1989

[30] Foreign Application Priority Data

Jun. 10, 1988 [SE] Sweden ..... 8802170

[51] Int. Cl.[5] ..... B01D 33/00

[52] U.S. Cl. ..... 210/154; 210/155; 210/162; 210/359

[58] Field of Search ..... 210/154, 155, 156, 158, 210/159, 161, 162, 359; 198/773

[56] References Cited

U.S. PATENT DOCUMENTS

| | | | |
|---|---|---|---|
| 1,698,387 | 1/1929 | Broome | 210/154 |
| 1,773,576 | 8/1930 | Downes | 210/154 |
| 1,999,637 | 4/1935 | Pettepher | 210/156 |
| 2,897,967 | 8/1959 | Arthur | 210/159 |
| 3,093,580 | 6/1963 | Siewert | 210/159 |
| 3,144,406 | 8/1964 | Crise | 210/159 |
| 3,477,579 | 11/1969 | Turner | 210/156 |
| 3,482,698 | 12/1969 | Ostnas | 210/159 |
| 3,834,538 | 9/1974 | Laman | 210/154 |

FOREIGN PATENT DOCUMENTS

| | | | |
|---|---|---|---|
| 98820 | 6/1983 | European Pat. Off. | 210/154 |
| 8607106 | 12/1986 | PCT Int'l Appl. | 210/155 |

*Primary Examiner*—Robert A. Dawson
*Assistant Examiner*—Joseph Drodge
*Attorney, Agent, or Firm*—Ostrolenk, Faber, Gerb & Soffen

[57] ABSTRACT

A system for removing objects from flowing liquid includes a screen for removing the objects from the liquid. The screen includes a movable component and a driving mechanism for moving the component through a closed path so as to move the objects upwardly. The system further includes a shield for pressing the objects against the screen. The shield is parallel to the screen. The system further includes supporting means for supporting the shield and for permitting the shield to be pushed away from the screen by the objects while maintaining the angular orientation of the shield with respect to the screen. The supporting means includes a linkage system which is connected to an upper portion of the shield.

8 Claims, 6 Drawing Sheets

DEVICE IN RINSING SCREENS

The present invention refers to a device in rinsing screens in flowing water, which screen is actuatable by a driving mechanism giving the screen a closed path of motion in its plane.

BACKGROUND OF THE INVENTION

It may occur that waste water contains rather big objects, e.g. plastic sacks containing night-soil, which with conventional, self-hoisting rinsing screens are difficult or impossible to handle. Another problem is that the screenings becomes tangled into balls, which may be so big that they can not be conveyed by the self-hoisting rinsing screens. The only possibility of solving these problems hitherto has been by manual operations, i.e it has been necessary to remove the objects by hand. As different types of rinsing screens, e.g. chain screens, step screens and the like operate fully automatically for long times such bigger objects may cause clogging and other types of breakdowns.

Another problem at self-hoisting rinsing screens of the type consisting of fixed and movable rods, having step-shaped edges facing the flow direction of the water, whereby the movable rods are interconnected to at least one pack, is that the movable rods are raised to a level above the lowermost step, which means that the lower part of the screen during this upward movement has a double slot width between the rods resulting in an inferior separation efficiency.

PURPOSE OF THE INVENTION

The purpose of the present invention is to provide a device in rinsing screens, which also can handle big objects floating against the screen or forming on the screen in consequence of the hoisting movement. The device shall be reliable in service and it shall not require any complex conveying apparatus. Another purpose of the invention is to provide an efficient rinsing effect at step screens also during the time the movable screen rods leave the lowermost step of the fixed screen rods. These objects have been achieved by the present invention.

DESCRIPTION OF THE DRAWINGS

The invention hereinafter will be further described with reference to the drawings, which show some embodiments thereof.

DESCRIPTION OF EMBODIMENTS

Figure 1:
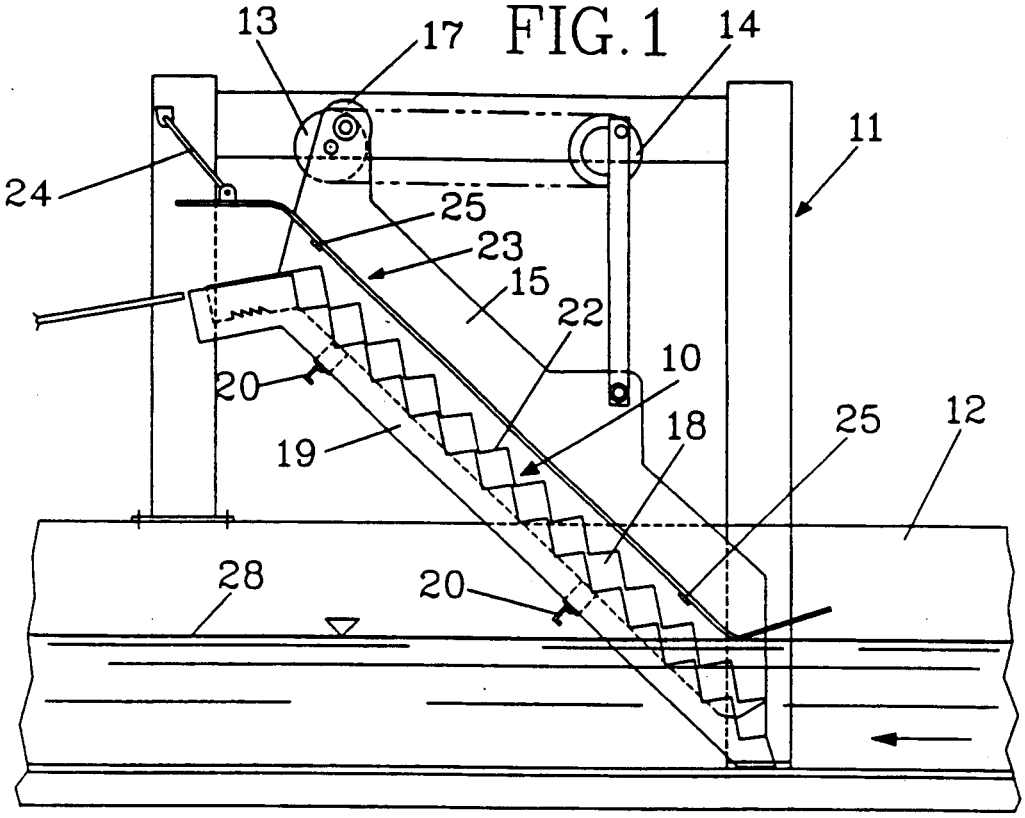
FIG. 1 shows in a side view a self-hoisting rinsing screen equipped with the device according to the invention in passive position.

The rinsing screen 10, shown in the drawing, is of a known type and it is positioned with its stand 11 in or on a gutter 12, in which the water to be rinsed is flowing. In the stand is supported eccentric sheaves 13 and 14, which are driven by a not further shown motor and said eccentric sheaves support via links 16 and 17 side plates 15, which in turn support movable screen rods 18 provided between fixed screen rods 19. Both the movable and the fixed screen rods 18, 19 at their edges facing the direction of water flow are step-shaped, whereby the movable rods 18 are interconnected via beams 20. Every other screen rod 19 is thus fixed and every other rod 18 movable, whereby the pack of movable rods by the eccentric sheaves are given a closed circular path 21 of motion, thus that particles that get caught on the steps 22 are lifted from step to step.

Figure 2:
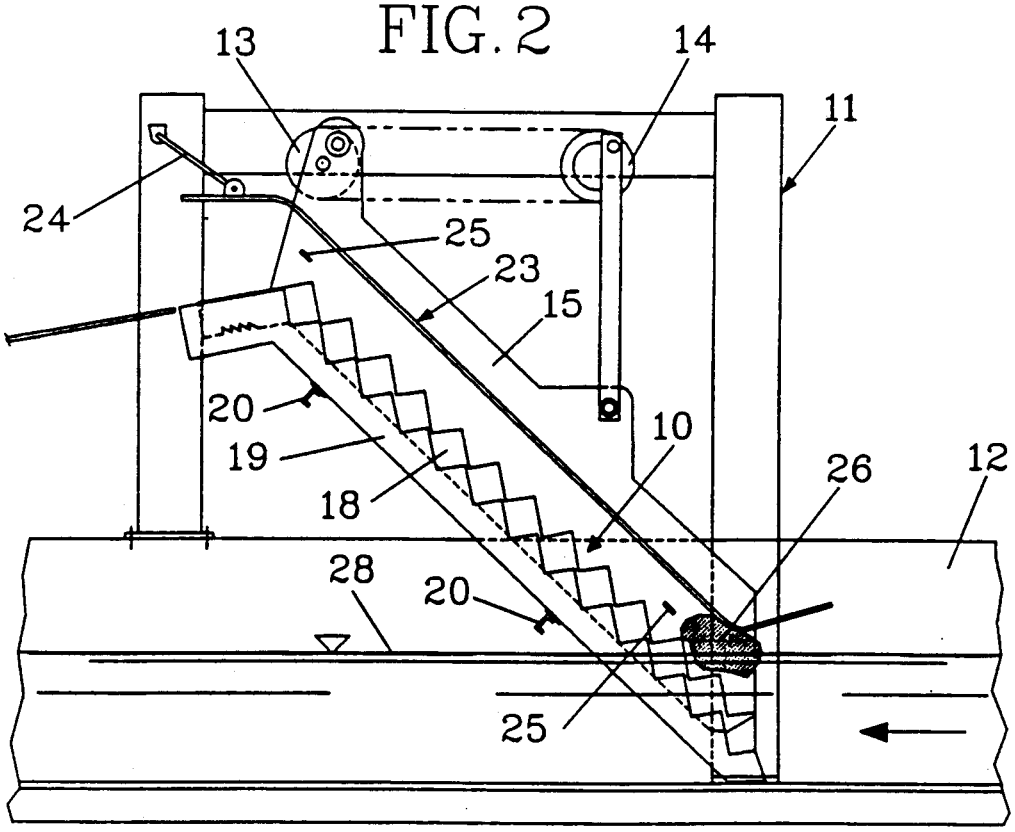
FIG. 2 shows the device according to FIG. 1 in active position, i.e. during hoisting of a big object.

Above the step-formed screen 10 is provided a shield 23, extending along a major part of the length of the screen. In the embodiment shown in FIGS. 1 and 2 the shield is a plate, e.g. of sheet metal or plastic, which at its upper part is suspended in a link 24 in such a manner that the shield may be lifted in a direction from fixed stop lugs 25 arranged thus that the shield in passive position is situated in near vicinity of the steps 22 of the movable rods 18. If a big object 26 should float against the screen or be formed as a ball by the circular movement of the screen, the shield 23 will be lifted in a direction away from the screen thus that the object 26 can "slip" between the shield and the movable rods. The shield 23 thus will exert a pressure upon the object 26, thus that this is retained during the hoisting movement of the movable rods 18.

Figure 3:
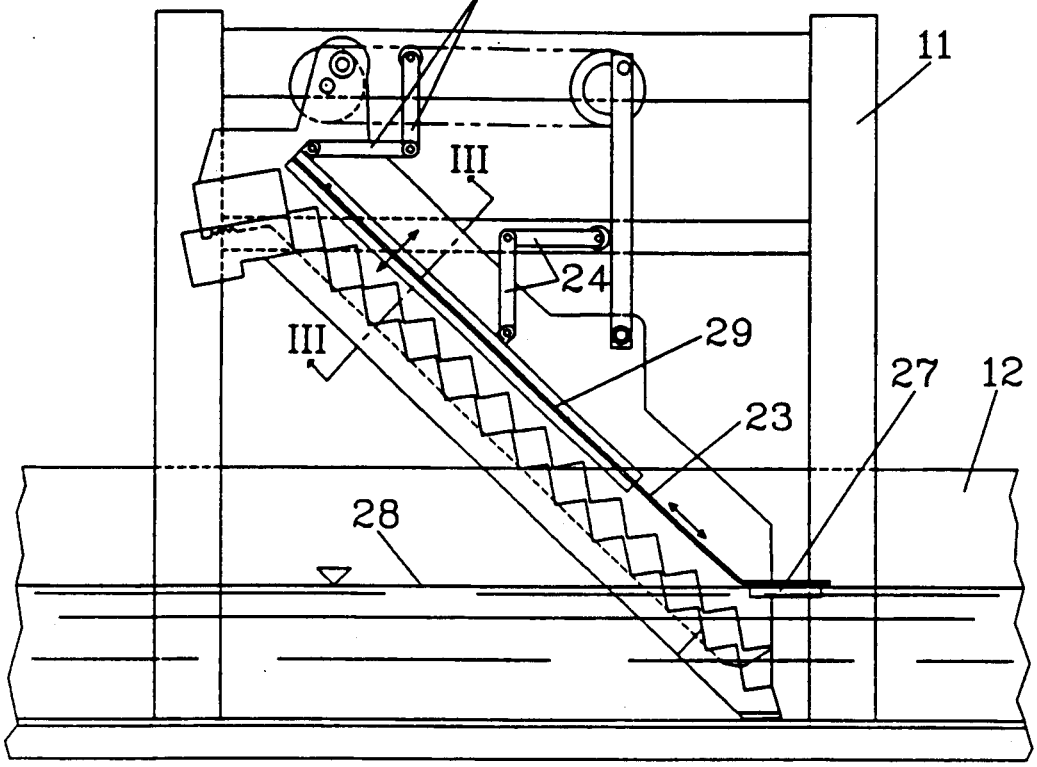
FIGS. 3 and 4 show views analogous with FIGS. 1 and 2 and showing a modified device according to the invention.
Figure 4:
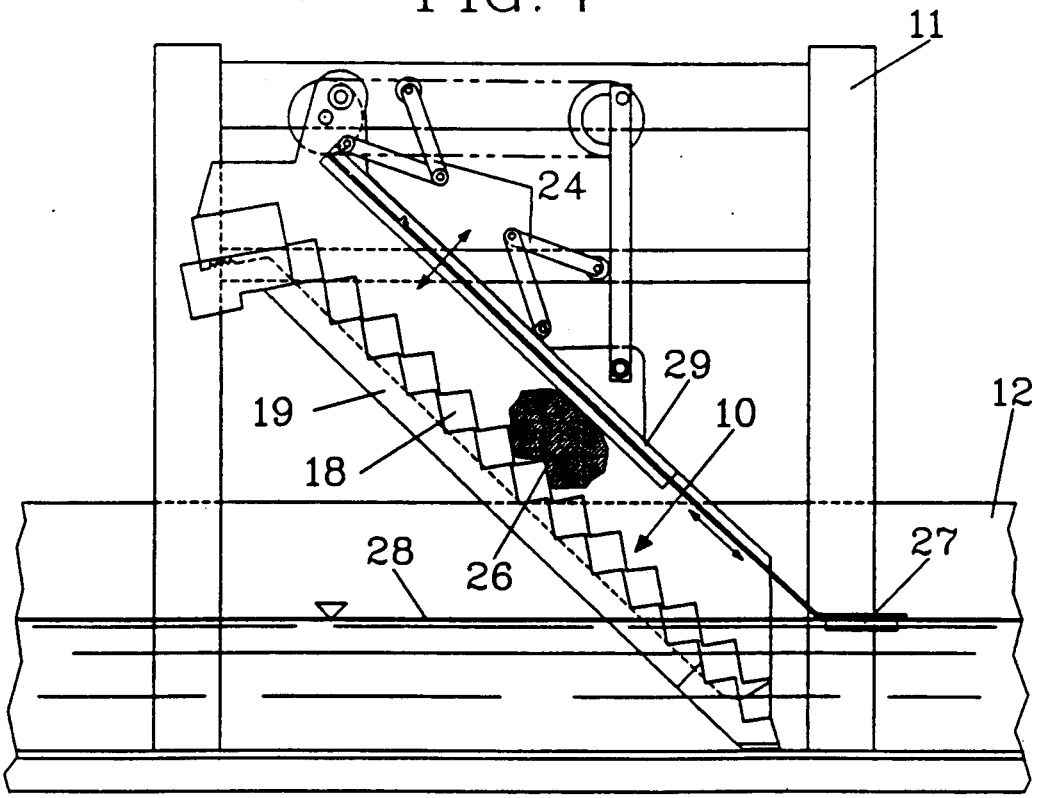

In the embodiment shown in FIGS. 3 and 4 the shield is supported by parallel link arms 24, which means that the shield 23 always will occupy a position in parallel with the rinsing screen. In this embodiment the link arms 24 are pivotably attached with one of their ends to guides 29, in which the side edges of the shield 23 is displaceable. At the lower end of the shield is provided a float 27, which keeps the shield in level with the water surface 28 in the gutter 12. In the same manner as in the embodiment according to FIGS. 1 and 2 the shield 23 will exert a pressure against a bigger object 26 and it will retain the object during the hoisting movement. If the shield had not been present the object would have rolled back and eventually blocked the screen.

Figure 5:
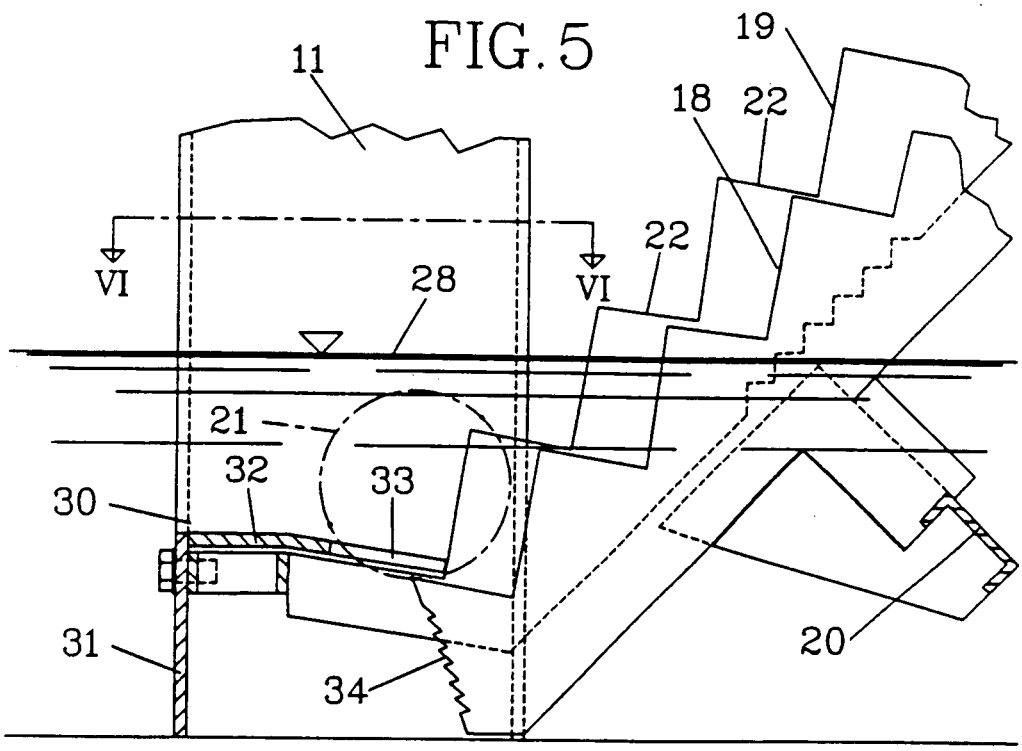
FIG. 5 shows in bigger scale the lower part of the rinsing screen provided with a covering member according to the invention.
Figure 6:
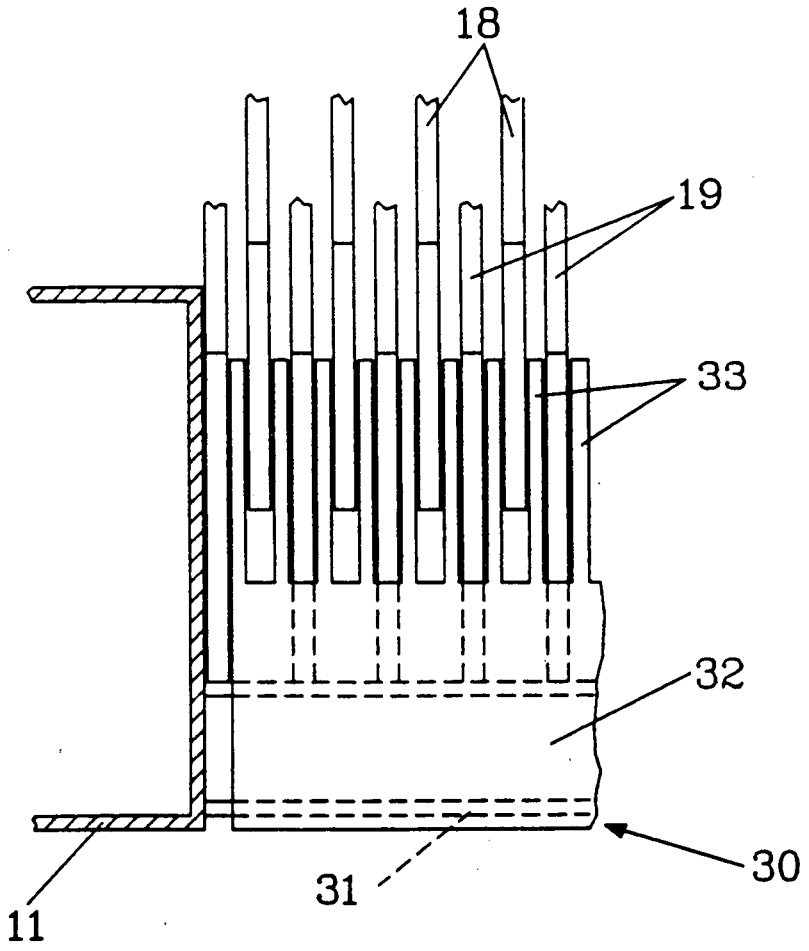
FIG. 6 is a section along line VI—VI in FIG. 5.

At the movement of the movable rods in their closed, circular path 21 the lower part of the fixed screen will be exposed, i.e. the free space between the fixed rods is doubled as the movable rods are situated in their upper position with the result that the separation effect of the screen is markedly reduced. In order to avoid this the lower end portion of the movable rods cooperate with a covering member 30, which in the embodiment shown in FIGS. 5 and 6 is constituted by a front plate 31 and a second part 32 arranged at an angle thereto and designed as a comb, the teeth 33 of which are arranged to extend between the movable rods 18, when these make their hoisting movement.

The front edge 34 of the lowermost step of the movable screen rods is designed with saw teeth, the purpose of which is to clean the comb at every rinsing stroke.

Figures 7, 8:
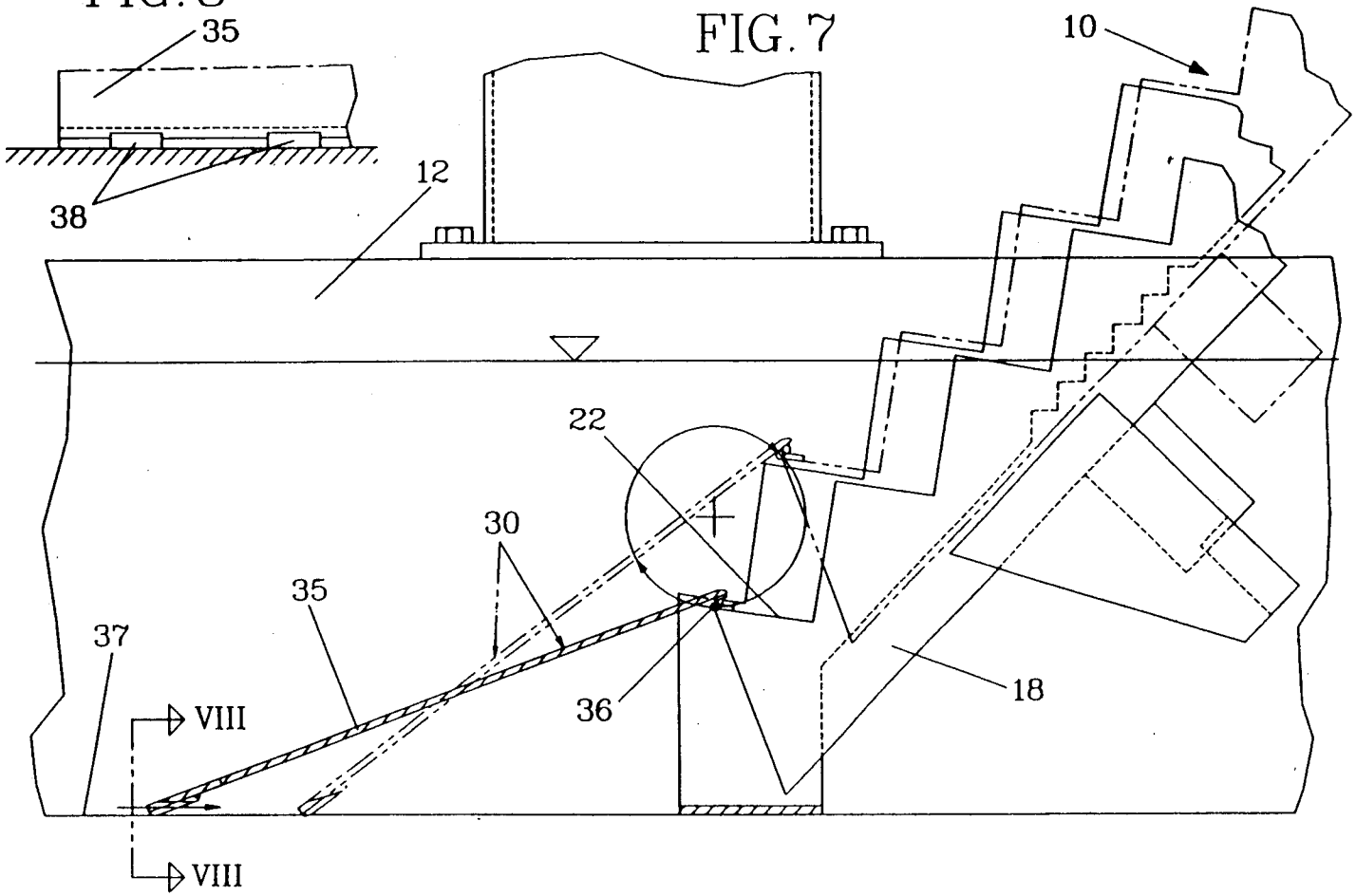
FIG. 7 shows a modified embodiment of the lower part of the rinsing screen, with the movable rods in two different operation positions.
FIG. 8 is a section along line VIII—VIII in FIG. 7.

In the embodiment according the FIGS. 7 and 8 to covering member 30 is constituted by a disc 35, which via a hinge 36 is articulatedly connected to the lower step 22 of the movable rods 18. The opposite end edge of the disc rests upon the bottom 37 of the gutter 12 under an appropriate angle thereto, thus that the water and the pollutants are led towards the rinsing screen 10. At every hoisting movement the disc 35 will participate and for preventing the disc 35 from leaving the bottom 37 it is possible to let the lower end of the disc be guided in appropriate guides (not shown). In order to prevent sediment from collecting below the disc 35 this is at its edge facing the bottom provided with openings 38 as a passage for the flow of water.

Figure 9:
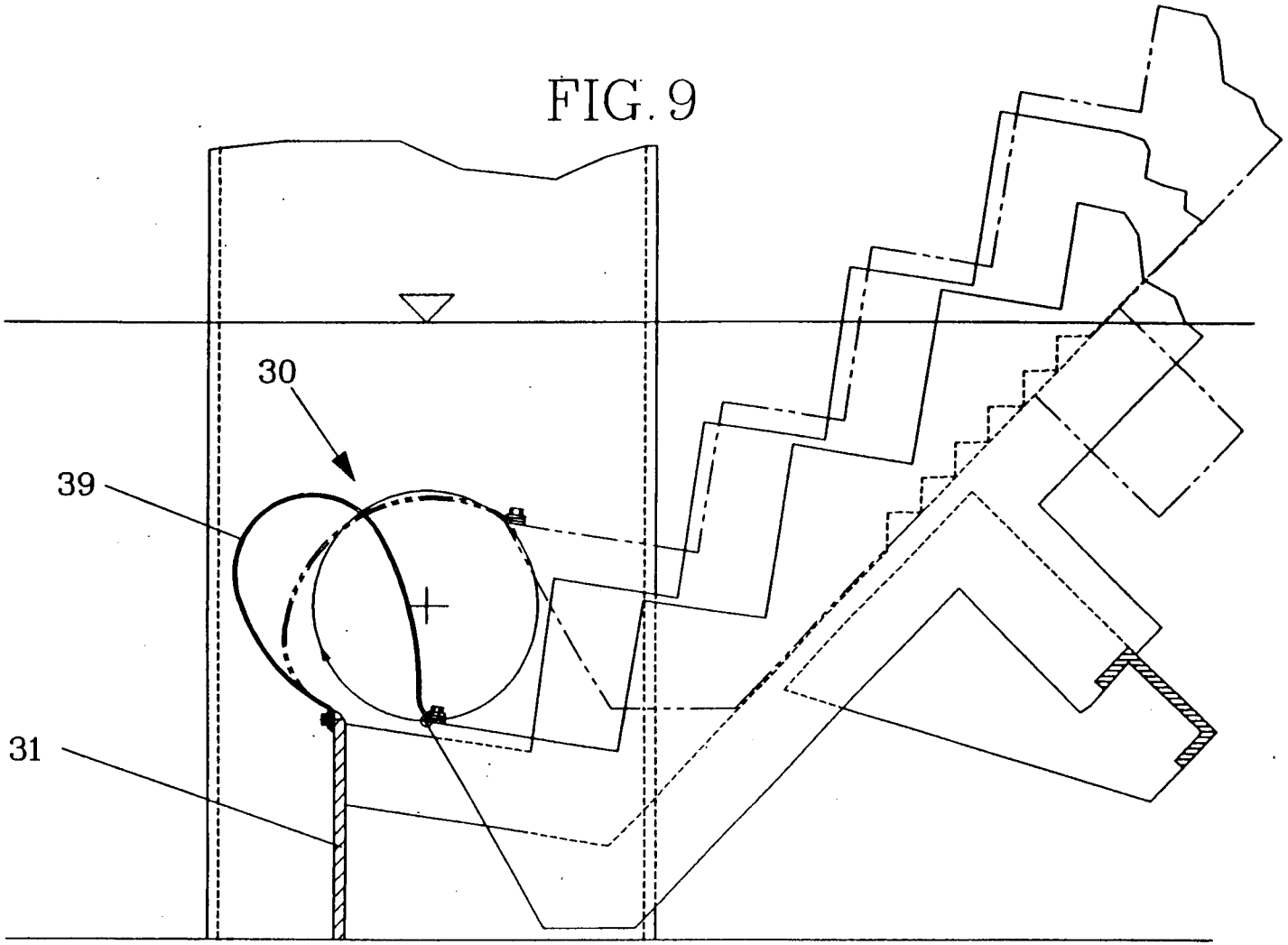
FIG. 9 shows further a variation of the lower part of the rinsing screen in side view and partly in section.

FIG. 9 shows a further embodiment of the covering member 30, which in the embodiment shown is constituted by a rubber cloth or the like, which with one of its end edges is attached to the lower step of the movable rods and at its opposite end to a front plate 31.

The invention has been shown in the accompanying drawings and been described in the associated description in connection to a step screen but the invention in its first aspect is applicable also to other types of rinsing screens, such as chain screens, grid screens and the like.

What I claim is:

1. A system for removing objects from flowing liquid, the system comprising:

a screen means for removing objects from flowing liquid, the screen means including a movable component and a driving mechanism for moving the component through a closed path so as to move the objects upwardly; and a shield means for pressing the objects against the screen, the shield means being oriented parallel to and extending along a major length of the screen means above the level of the flowing liquid; and supporting means for supporting the shield means and for permitting the shield means to be pushed away from the screen means by the objects while maintaining the parallel orientation of the shield means with respect to the screen means throughout the removing of the objects, the supporting means including a linkage system which is connected to an upper portion of the shield means.

2. A system as claimed in claim 1, wherein the screen means includes fixed screen rods, the movable component of the screen means including movable screen rods, the movable screen rods being parallel to the fixed screen rods, the driving mechanism being adapted to move the movable screen rods through a closed circular path so as to move the objects upwardly.

3. A system as claimed in claim 2, wherein the fixed and movable screen rods have step shaped surfaces.

4. A system as claimed in claim 2, wherein the supporting means includes a guide for slidably supporting the shield means.

5. A system as claimed in claim 4, wherein the shield means includes a float for supporting the shield means above the flowing liquid, the float being located at a lower end of the shield means.

6. A system as claimed in claim 5, wherein the supporting means includes a frame which is fixed with respect to the fixed screen rods, the linkage system including first, second, third and fourth link arms, a first end of the first link arm being rotatably connected to the frame, a first end of the second link arm being rotatably connected to a second end of the first link arm, a second end of the second link arm being rotatably connected to the guide, a first end of the third link arm being rotatably connected to the frame, a first end of the fourth link arm being rotatably connected to a second end of the third link arm, a second end of the fourth link arm being rotatably connected to the guide.

7. A system as claimed in claim 2, wherein the supporting means includes a fixed stop for limiting the movement of the shield means.

8. A system as claimed in claim 2, wherein the shield means is a smooth plate of sheet metal or plastic.

* * * * *